US006902250B2

(12) United States Patent
Yamashita et al.

(10) Patent No.: US 6,902,250 B2
(45) Date of Patent: Jun. 7, 2005

(54) INK-JET RECORDING METHOD AND INK-JET RECORDING APPARATUS FOR DISPLACING RECORDING HEAD FROM PRINTING POSITION WHEN PRINTING IS BEING STOPPED

(75) Inventors: Kunichi Yamashita, Kanagawa (JP); Atsushi Suzuki, Kanagawa (JP); Toshitake Yui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/446,815

(22) Filed: May 29, 2003

(65) Prior Publication Data

US 2004/0027415 A1 Feb. 12, 2004

(30) Foreign Application Priority Data

May 29, 2002 (JP) ..... 2002-155322

(51) Int. Cl.[7] ..... B41J 23/00
(52) U.S. Cl. ..... 347/37
(58) Field of Search ..... 347/8, 37, 19, 347/22, 29, 32, 44, 56, 100

(56) References Cited

U.S. PATENT DOCUMENTS 5,085,698 A 2/1992 Ma et al. ..... 524/388
5,172,133 A 12/1992 Suga et al. ..... 347/100
5,221,334 A 6/1993 Ma et al. ..... 347/100
6,042,217 A * 3/2000 Jones ..... 347/32
6,402,288 B2 * 6/2002 Rhodes et al. ..... 347/29

FOREIGN PATENT DOCUMENTS

JP A 56-147871 11/1981
JP A 8-3498 1/1996
JP A 8-31944 2/1996
JP A 10-110129 4/1998
JP A 10-510862 10/1998
JP 11035861 A * 2/1999 ..... C09D/11/00

* cited by examiner

*Primary Examiner*—Hai Pham
(74) *Attorney, Agent, or Firm*—Oliff & Berridge, PLC

(57) ABSTRACT

The present invention provides an ink-jet recording method adopting an ink-jet recording apparatus including a printer head, which accommodates one or more kinds of ink and has a nozzle face on which one or more nozzles are provided, wherein the printer head is tilted when printing is being stopped so that an axis intersecting with the nozzle face at a right angle is displaced by 3 or more degrees from a direction of the axis when printing is being conducted, and an ink-jet recording apparatus used in the method.

21 Claims, 2 Drawing Sheets

INK-JET RECORDING METHOD AND INK-JET RECORDING APPARATUS FOR DISPLACING RECORDING HEAD FROM PRINTING POSITION WHEN PRINTING IS BEING STOPPED

CROSS-REFERENCE TO RELATED APPLICATION

This application claims priority under 35 USC 119 from Japanese Patent Application No. 2002-155322, the disclosure of which is incorporated by reference herein.

BACKGROUND OF THE INVENTION

1. Field of the Invention

The present invention relates to an ink-jet recording method and an ink-jet recording apparatus.

2. Description of the Related Art

Many ink-jet recording apparatuses (hereinafter, also referred to as "printers") have been sold on the market for monochrome or full-color printing. These printers employ an ink-jet recording method in which a liquid or fused ink is discharged from nozzles, slits, a porous film or the like to record images on a recording medium such as a paper sheet, a cloth, or a film. Such printers are advantageous due to their compactness, inexpensiveness, and silence. Among them, printers utilizing a so-called piezo ink-jet recording method in which a piezoelectric element is used, or a so-called thermal ink-jet recording method in which droplets are formed with thermal energy to record images have many advantages such as high-speed printing, and high resolution.

The above-described ink-jet recording methods generally utilize inks which contain water-soluble dyes (hereafter, also referred to as "dye inks"). These inks possess excellent long-term storage stability, however, they are problematic in that they do not have sufficient resistance to water and light. In contrast, inks containing pigments (hereafter, also referred to as "pigment inks") possess excellent resistance to water and light, and further, they produce image quality with high density and no blotting or blurring. For this reason, pigment inks have been very promising and many proposals have been made and put into practice utilizing this technology.

Japanese Patent Application Laid-Open (JP-A) No. 56-147871 proposes a pigment ink made from an aqueous medium containing at least a pigment, a polymer dispersant, and a nonionic surfactant. U.S. Pat. Nos. 5,085,698 and 5,221,334 propose the utilization of an AB or BAB block copolymer as a pigment dispersant. U.S. Pat. No. 5,172,133 teaches a pigment ink which uses a specified pigment, a water-soluble resin, and a solvent.

Due to the fact that pigments are not water soluble, a diepersant is used to disperse them throughout the ink. In contrast to this, research is being conducted on developing self-dispersing pigments that can easily disperse through ink via hydrophilic processing. Such pigment inks are described in various patent documents, such as JP-A Nos. 8-3498 and 8-31944, where pigment inks using a carbon black pigment are taught. In these applications, the carbon black has a surface-active hydrogen content of 1.5 mmol/g obtained through oxidation treatment. Another pigment ink is taught in Japanese National Publication No. 10-510862, where the ink uses a hydrophilic pigment prepared by introducing a hydrophilic group into the surfaces of carbon black particles via a connecting group, which is comprised of an aromatic group and analkyl group. Further, in JP-A No. 10-110129, an ink using a pigment processed with a sulfonating agent is described.

When utilizing pigment inks, however, the image quality varies to a large degree depending on the type of paper used. Depending on the paper, there are cases where the optical density of a printed image is low. This is due to the fact that the optical density of pigment inks is obtained by the trapping of the ink, mainly in the surface vicinity of the paper. This is in contrast to dye inks, where the color material actually dyes the paper fibers. It is thought that in pigment inks, the balance between the penetration and coagulation of the pigment in the paper surface greatly varies depending on the type of paper used.

It is possible to improve the technology and reduce the optical density variance caused by varying paper types. For example, the diameters of the particles dispersed in the ink can be increased; the number of the particles, made from a water-insoluble substance such as a pigment having particle diameters of 0.5 $\mu$m or more, can be increased; or the coagulability of the ink's colorant can be enhanced.

When ink contains water-insoluble substance having dispersed particles with increased diameters, where the number of particles with diameters of 0.5 $\mu$m or more is increased, and the coagulation of the pigment is also increased, problems can occur. For example, if a printer is left unused for a long period of time, the ink nozzles tend to clog when printing is restarted.

Therefore, there is a need for an ink-jet recording method in which an ink does not easily cause a nozzle to clog when printing is reinitiated after a long period of non-use. Moreover, these is a need for an ink-jet recording apparatus implementing this method.

SUMMARY OF THE INVENTION

A first aspect of the invention provides an ink-jet recording method adopting an ink-jet recording apparatus comprising a printer head, which accommodates one or more kinds of ink and has a nozzle face on which one or more nozzles are provided, wherein the printer head is tilted when printing is being stopped so that an axis intersecting with the nozzle face at a right angle is displaced by 3 or more degrees from a direction of the axis when printing is being conducted.

A second aspect of the invention provides an ink-jet recording apparatus used in the ink-jet recording method, comprising: a printer head having a unit accommodating one or more kinds of ink and a nozzle face on which one or more nozzles are provided; and a printer head rotating means, wherein the printer head is tilted when printing is being stopped so that an axis intersecting with the nozzle face at a right angle is displaced by 3 or more degrees from a direction of the axis when printing is being conducted.

DETAILED DESCRIPTION OF THE INVENTION

Figure 1A:
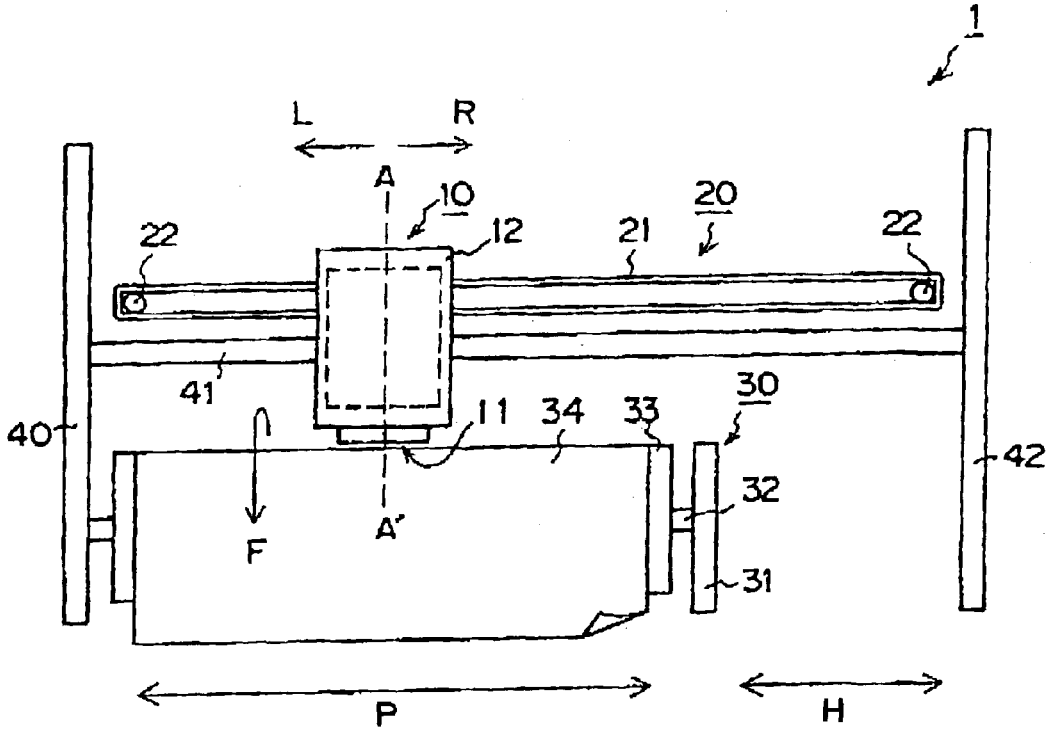
FIG. 1A is a front view of the internal structure of an example of an ink-jet recording apparatus of the invention and shows a state when printing is being conducted.

An ink-jet recording method and an ink-jet recording apparatus implementing the same will be explained in this order.

<Ink-jet Recording Method>

In an ink-jet recording method of the invention, an ink-jet recording apparatus having at least an ink-jet recording printer head (hereinafter, also referred to as a "head" for short), which accommodates one or more kinds of ink and has a nozzle face on which one or more nozzles are provided is used, and the printer head is tilted when printing is being stopped so that an axis intersecting with the nozzle face at a right angle (hereinafter also referred to as a "nozzle axis") is displaced from a direction of the axis when printing is being conducted by 3 or more degrees.

Accordingly, even if the ink-jet recording apparatus is left unused for a long period of time and thereafter printing is restarted, nozzle clogging (hereinafter, also referred to as "nozzle clogging after leaving the printer unused") can be prevented.

On the other hand, in the case where the nozzle axis is, when printing is being stopped, displaced from a direction of the axis when printing is being conducted by an angle of less than 3°, nozzle clogging after leaving the printer unused cannot be prevented.

Note that the reason why nozzle clogging after leaving the printer unused is prevented is still not definite, but it is inferred as follows.

In general, when particles with diameters exceeding a specific limit are dispersed in a liquid, the particles tend to settle in the liquid. This is due to the fact that, according to Stokes' equation associated with sedimentation, sedimentation speed increases in proportion to the square of a particle diameter, and the sedimentation speed of particles having diameters larger than a specific limit overcome diffusion thereof due to thermal motion. Hence, in the case where particles made of water-insoluble substance having such a diameter that sedimentation takes place are originally contained in an ink or grow during storage, such particles come to gradually localize in a gravitational direction in the interior of the head accommodating the ink and the interiors of the nozzles over time.

Therefore, it is considered that in the case where the water-insoluble substance deposits in the nozzle face side of the head interior and in the nozzles with succession of a state where no printing is conducted for a long period of time, ink ejectability becomes degraded, causing nozzle clogging after leaving the printer unused when printing is intended to restart.

However, in the case where the head is left stopped for a long period of time, with the nozzle axis displaced from a direction of the nozzle axis when printing is being conducted, ordinarily a direction of a gravitational axis, by an angle of 3 or more degrees, the direction of the nozzle axis when printing is being conducted differs from that when printing is being stopped. Therefore, when printing is restarted after the printer is left for a long period of time, printing operation is hardly affected by sediments localizing and depositing in the gravitational direction while printing is being stopped, thereby enabling the nozzle clogging after leaving the printer unused to be prevented.

In order to more effectively prevent the nozzle clogging after leaving the printer unused, it is preferably to tilt the nozzle axis by 5 or more degrees, when printing is being stopped, from a direction of the nozzle axis when printing is being conducted.

Use of the ink-jet recording method of the present invention adequately displays the non-clogging effect for nozzles that have been left unused, regardless of the resolution or recording system being used. However, with regards to resolution, when the dpi is 400 or more, the present invention displays even more effective non-clogging capabilities.

Furthermore, as to ink-jet recording methods, the effect is exhibited more effectively in the case where a thermal ink-jet recording method is employed. This is because, in the thermal ink-jet recording method, an ink is discharged from nozzles with thermal energy, and insoluble matter in the ink easily coagulates during printing, which easily causes the nozzle clogging after leaving the printer unused. More specifically, the nozzle clogging after leaving the printer unused can be effectively prevented by employing a combination of a thermal ink-jet recording method and the invention.

Note that the phrase "when printing is being stopped" refers to two situations, namely, where the printer power has been switched off and the printer is incapable of printing, as well as cases where the printer is on but printing is not being carried out. In the case of the latter, the phrase specifically refers to any period of time where the printer is at least able to respond to commands (from either an external unit such as a personal computer or from the operation panel of the printer itself), but where no printing is being performed; or any period of time within a successive time span where printing is not being performed.

Furthermore, a motion in which the head is moved such that the nozzle axis is displaced from the gravitational direction may be conducted immediately after printing is over. However, this may lower a printing speed if a printing operation is executed intermittently at an interval of tens seconds to tens minutes.

Accordingly, within a constant period of time after the termination of printing, the nozzle axis is maintained in a position where the nozzle faces the same direction as when printing is being performed, so that it can immediately respond to the resumption of printing (hereafter referred to as "print-ready state"). It is preferable that the nozzle axis be moved so the nozzle faces a direction away from the direction of the gravitational axis, when a predetermined period of time elapses after the termination of printing.

The term a "prescribed time" is preferably in the range of about 1 minute to about 24 hours though it is impossible to specify a definite range since criteria with which it is determined whether or not the printer is in the print-ready state are different according a printer designed in accordance with individual specifications.

Then, more detailed description will be given of a direction of a nozzle axis, an angle when a direction of the nozzle axis alters, and the like.

The invention has a feature that the nozzle axis is displaced, when printing is being stopped, by 3 or more angles, from a direction thereof when printing is being conducted, and in this case, an angle by which a direction of the nozzle axis alters (hereinafter, also referred to as a "nozzle axis rotational angle" for short) means an angle of a component parallel to a gravitational axis. Therefore, in the case where the nozzle axis is rotated along a surface intersecting obliquely with a gravitational axis, it is required that an angle of a component of each of rotational angles of the nozzle axis which component is parallel to the gravitational axis meets the above-described requirement.

Note that in the invention, the term a "gravitational axis" means an axis parallel to a direction in which a gravitational force acts, and the term a "direction at a gravitational axis" means a direction in which a gravitational force (a vector) acts and more specifically, a vector parallel to a gravitational axis, and directing toward the ground surface side.

An angle between the gravitational axis and the nozzle axis when printing is being stopped and when the nozzle axis is displaced from the direction of the gravitational axis (hereafter, referred to as "at a time of standby") is preferably in the range of 3° to 110° and more preferably in the range of 5° to 90°.

If an angle of the nozzle axis standing by to the direction of the gravitational axis is larger than 110°, discharging ability of an ink may be degraded when printing is restarted after the printer is left unused for a long period of time. On the other hand, if the angel is less than 3°, the effect of improving nozzle clogging after leaving the printer unused is hard to attain.

In most of commercially available printers, a nozzle face faces the ground surface side when printing is being conducted. In this case, clogging described above is most likely to occur. Therefore, an ink-jet recording method of the invention is especially preferably used in the case where a nozzle face faces the ground surface side when printing is being conducted.

The phrase "a nozzle face faces the ground surface side" means that the nozzle face faces the ground surface and intersects with a gravitational axis at a substantially right angle (within 90°±10°).

Ink

Next, an ink preferably used in an ink-jet recording method of the invention described above will be described hereinafter.

Water-insoluble Substance

At least one ink used in the invention preferably contains at least one water-insoluble substance.

If the ink contains no water-insoluble substance, various problems may arise that a printed image is excessively low in optical density, poorer in water resistance and the like.

The water-insoluble substance described above is a material not soluble in water and any material can be used as far as it can be used in order to exert or improve various characteristics and functions of an ink. Examples thereof include a pigment and an oil emulsion colored with a pigment; colored polymer or wax; colorless or white fine particles such as a colloid or the like made of a resin emulsion or an inorganic oxide. Concrete examples of water insoluble substances such as a resin emulsion, an inorganic oxide and a pigment will be described in detail.

Water-insoluble Substance (1) Resin Emulsion

Examples of a resin emulsion used in the invention include: an acrylic resin, a vinyl acetate resin, a styrene-butadiene resin, an acrylic acid-styrene resin, a polybutadiene resin, a polystyrene resin, a polyurethane resin, a polyolefin resin, a polyester resin, a polyamide resin, a melamine resin, an urea resin, a silicone resin, a fluorine-containing resin, a polybutene resin, and various kinds of waxes.

Furthermore, examples of a commercially available resin emulsion include, but are not limited to, Bon Coat 4001 (an acrylic resin emulsion made by Dainippon Ink and Chemicals, Incorporated), Bon Coat 5454 (a styrene-acrylic resin emulsion made by Dainippon Ink and Chemicals, Incorporated), and J-74J and J-734 (made by Johnson Polymer Co.)

No specific limitation is placed on a production method for a resin emulsion, but any of the following methods can be employed: a method in which a resin or a wax is mechanically divided into fine particles and dispersed in an aqueous medium, methods in which fine particles are directly polymerized through emulsion polymerization, dispersion polymerization, or suspension polymerization.

The resin emulsion preferably used in the invention is a polymer containing both a hydrophilic moiety and a hydrophobic moiety. Particles of the resin emulsion may have any shape, such as that of a sphere. The resin emulsion may be produced by emulsion polymerization either using an emulsifier or under soap-free conditions.

Water-insoluble Substance (2): Inorganic Oxide

Examples of inorganic oxide used in the invention include, but are not limited to, silicic anhydride ($SiO_2$) with high molecular weight, and alumina ($Al_2O_3$)

Water-insoluble Substance (3): Pigment

As pigments used in the invention, any of organic pigments and inorganic pigments can be employed.

Usable black pigments include carbon black pigments such as furnace black, lamp black, acetylene black, or channel black, and specific examples thereof include, but are not limited to, Raven 7000, Raven 5750, Raven 5250, Raven 5000 ULTRA II, Raven 3500, Raven 2000, Raven 1500, Raven1250, Raven 1200, Raven 1190 ULTRA II, Raven 1170, Raven 1255, Raven 1080 and Raven 1060 (made by Columbian Carbon Company); Regal 400R, Regal 330R, Regal 660R, Mogul L, Black Pearls L, Monarch 700, Monarch 800, Monarch 880, Monarch 900, Monarch 1000, Monarch 1100, Monarch 1300 and Monarch 1400 (made by Cabot Corporation); Color Black FW1, Color Black FW2, Color Black FW2V, Color Black 18, Color Black FW200, Color Black S150, Color Black S160, Color Black S170, Pritex 35, Pritex U, Pritex Vrintex 140U, Printex 140V, Special Black 6, Special Black 5, Special Black 4A and Special Black k4 (made by Deggusa Co., Ltd); and No. 25, No. 33, No. 40, No. 47, No. 52, No. 900, No. 2300, MCF-88, MA 600, MA7, MA8 and MA100 (made by Mitsubishi Chemical Co., Ltd)

While a preferable structure of carbon black used as a pigment cannot be commonly discussed, it is preferable that a particle diameter thereof is in the range of 15 to 30 nm, that a BET specific surface area is in the range of 70 to 300 $m^2/g$, that a DBP oil absorption value is in the range of 0.5 to $1.0\times10^{-3}$ l/g, that a content of volatile matter is in the range of 0.5 to 10% by weight and that an ash content is in the range of 0.01 to 1.0% by weight. If carbon black with specifications outside the ranges described above is used, the diameter of the dispersed particles in an ink may be too large.

Examples of cyan pigment include, but are not limited to, C. I. Pigment Blue-1, C. I. Pigment Blue-2, C. I. Pigment Blue-3, C. I. Pigment Blue-15, C. I. Pigment Blue-15:1, C. I Pigment Blue-15:3, C. I. Pigment Blue-15:34, C. I. Pigment Blue-16, C. I. Pigment Blue-22, and C. I. Pigment Blue-60.

Examples of magenta pigment include, but are not limited to, C. I. Pigment Red 5, C. I. Pigment Red 7, C. I. Pigment Red 12, C. I. Pigment Red 48, C. I. Pigment Red 48:1, C. I. Pigment Red 57, C. I. Pigment Red 112, C. I. Pigment Red 122. C. I Pigment Red 123, C. I. Pigment Red 146, C. I. Pigment Red 168, C. I. pigment Red 184, and C. I. Pigment Red 202.

Examples of yellow pigment include, but are not limited to, C. I. Pigment Yellow-1, C. I. Pigment Yellow-2, C. I. Pigment Yellow-3, C. I. Pigment Yellow-12, C. I. Pigment Yellow-13, C. I. Pigment Yellow-14, C. I. Pigment Yellow-16, C. I. Pigment Yellow-17, C. I. Pigment Yellow-73, C. I. Pigment Yellow-74, C. I. Pigment Yellow-75, C. I. Pigment Yellow-83, C. I. Pigment Yellow-93, C. I. Pigment Yellow-95, C. I. Pigment Yellow-97, C. I. Pigment Yellow-98, C. I. Pigment Yellow-114, C. I. Pigment Yellow-128, C. I. Pigment Yellow-129, C. I. Pigment Yellow-151, and C. I. Pigment Yellow-154.

In addition to black pigments and pigments of three primary colors, including the cyan, magenta and yellow color described above, pigments of specific colors such as red, green, blue, brown, or white, metallic luster pigments such as gold or silver, colorless or light color filers and plastic pigments may be used. Moreover, in addition to the above-described pigments, newly synthesized pigments may also be used.

Pigment particles used in the invention may be surface-treated in advance.

Example of surface treatment methods include a surface treatment with an alcohol such as ethanol or propanol; a surfactant treatment; a pigment derivative treatment for substituting an acidic group or a basic group; a pigment covering reaction treatment for covering surfaces of pigment particles with other substance; a surface chemical reaction treatment for introducing a substituent through a condensation reaction or a graft reaction; a coupling reaction treatment for treating a surface with a silane coupling agent, a zirconate coupling agent, or an aluminate coupling agent, a plasma reaction treatment, and a CVD treatment.

Usable pigments that are surface-treated and self-dispersible in water can be commercially available pigments such as Cab-o-jet-200, Cab-o-jet-300 and IJX-55 made by Cabot Corporation; Microjet Black CW-1, and Microjet Black CW-2 made by Orient Chemical Industries, Ltd.; and pigments made by Nippon Shokubai Co., Ltd.

Average Diameter of Water-insoluble Substance Particles

A volume mean diameter of the water-insoluble substance particles contained in the ink is preferably in the range of 50 to 250 nm, more preferably in the range of 100 to 200 nm and especially preferably in the range of 120 to 200 nm.

If the volume mean diameter of the water-insoluble substance particles is less than 50 nm, an optical density of a printed image may easily decrease and a variation in optical density depending on the type of paper sheet used may easily increase. On the other hand, if the volume mean diameter exceeds 250 nm, clogging at the distal end of a nozzle may easily occur and flight properties of the ink at the time of printing may easily deteriorate.

A number-average diameter of the water-insoluble substance particles contained in the ink is preferably in the range of 30 to 150 nm, more preferably in the range of 60 to 130 nm and still more preferably in the range of 80 to 130 nm.

If the number-average diameter of the water-insoluble substance particles is less than 30 nm, an optical density of a printed image may easily decrease and variation in optical density depending on the type of paper sheet used may easily increase. On the other hand, if the number-average particle diameter exceeds 150 nm, clogging of the distal end of the nozzle may easily occur and flight properties of the ink at the time of printing may easily deteriorate.

Particle Size Distribution of Pigment

In the case where the water-insoluble substance is a pigment, a particle size distribution mv/mn expressed by a ratio of the volume mean particle diameter mv to the number-average particle diameter mn of the pigment is preferably not greater than 3 and more preferably not greater than 2.5. In particular, in the case where carbon black made hydrophilic is used as a pigment self-dispersible in water, the particle size distribution mv/mn is preferably not greater than 2.2 in terms of rubfastness of the printed image.

If the particle size distribution is larger than 3, a penetrating speed of the pigment through a surface of a paper sheet becomes slower and rubfastness of the printed image lowers. A particle size distribution mv/mn is 1 in the case of monodispension and it is ideally desired that the distribution approaches this value, but currently, it is hard to attain a monodispersion state where a particle size distribution mv/mn is 1 and the particle size distribution is usually 1.1 or higher.

Number of Water-insoluble Substance Particles

The number of water-insoluble substance particles having a particle diameter of 0.5 $\mu$m to 5 $\mu$m is preferably in the range of $0.2\times10^4$ to $1000\times^4$ per 1 $\mu$l of an ink, more preferably in the range of $1\times10^4$ to $1000\times10^4$ per 1 $\mu$l of an ink and still more preferably in the range of $25\times10^4$ to $1000\times10^4$ per 1 $\mu$l of an ink.

If the number of water-insoluble substance particles having a particle diameter of 0.5 $\mu$m to 5 $\mu$m is less than $0.2\times10^4$ particles per 1 $\mu$l of an ink, an optical density of the printed image may decrease and a variation in optical density depending on the type of paper sheet used may increase. On the other hand, if it exceeds $1000\times10^4$ particles per 1 $\mu$l of an ink, nozzle clogging after leaving the printer unused and falling out of image at time of printing may occur.

Method for Measuring Diameter of Water-insoluble Substance Particles and Number of Particles Thereof In measurement of the particle diameter of dispersed particles made of the water-insoluble substance such as the pigment dispersed in the ink, a microtrack UPA particle size analyzer 9340 (made by Leeds & Northrup Co.) is used as a measuring apparatus and a measuring sample is prepared by diluting an ink, in which the water-insoluble substance to be measured is dispersed, 1000 times.

Parameters inputted to the particle size analyzer at the time of measurement are such that a viscosity used is that of pure water and a dispersed particle density used is that of water-insoluble substance particles, respectively. The density of the dispersed particles is set to 1.8 g/cm$^3$, for example, in the case where a carbon black made hydrophilic is used as a pigment.

The number of particles of the water-insoluble substance having a particle diameter of 0.5 $\mu$m to 5 $\mu$m is measured with an Accusizer TM770 Optical Particle Sizer (made by Particles Sizing Systems Inc.) as a measuring apparatus.

The apparatus detects particles passing through a measuring section with an optical technique. In measurement, 2 $\mu$l of an ink to be measured is put in a measurement cell and the number of particles is measured according to a predetermined measuring method of the measuring apparatus. The particle number obtained is divided by 2 to convert it into a value contained in 1 $\mu$l of the ink.

Addition Amount of Pigment in Ink

An addition amount of the pigment, which is a main component of the water-insoluble substance contained in the ink, is preferably in the range of 1 to 20% by weight, more preferably in the range of 2 to 15% by weight and still more preferably in the range of 3 to 10% by weight, relative to the entire weight of the ink.

If the addition amount of the pigment is more than 20% by weight, clogging at the nozzle distal end may easily occur and rubfastness of the printed image may be degraded. On the other hand, if the addition amount of the pigment is less than 1% by weight, an optical density of the printed image may not be sufficient and a variation in optical density depending on the type of paper sheet used in printing may increase.

Other Components in Ink

The ink of the invention may contain a known component used in an ink, for example a solvent, a penetrant and the like as well as the water-soluble substance described above. Description of the typical components will be given below.

The ink of the invention can preferably contain a surfactant for controlling the characteristics thereof. The surfactant may be any of nonionic, anionic, cationic and amphoteric surfactants, but, in order to suppress interaction with a surface ionicity of the water-insoluble substance, an ionic or a nonionic surfactant of the same kind as the surface ionicity is preferable and a nonionic surfactant is especially preferable.

Example of usable nonionic surfactant include polyoxyethylenenonyl phenyl ether, polyoxyethyleneoctyl phenyl ether, polyoxyethylenedodecyl phenyl ether, polyoxyethylenealkyl ether, polyoxyethylene fatty acid ester, sorbitan fatty acid ester, polyoxyethylene/polyoxypropylene block copolymer, polyoxyethylenesorbitan fatty acid ester, a fatty acid alkylolamide, and an acetylene glycol derivative (surfinol).

Example of usable anionic surfactant include an alkylbenzene sulfonate, an alkylnaphthalene sulfonate, a forlmalin condensate of an alkylnaphthalene sulfonate, a higher fatty acid salt, a sulfate ester of a higher fatty acid ester, a sulfonate of a higher fatty acid ester, a sulfate ester and a sulfonate of a higher alcohol ether, an alkylcarboxylate of a higher alkylsulfoneamide, a sulfosuccinate, an ester salt of a sulfosuccinate, an alkylphophite, an alkylphosphate, an alkylphosphonate, an ester of an alkylphosphonate, and a phosphate ester of higher alcohol.

Examples of unable cationic surfactant include a primary amine salt, a secondary amine salt, a tertiary amine salt, and a quaternary ammonium salt and examples of amphoteric surfactant include betain, sulfobetain, and sulfate betain.

In addition, silicone surfactants such as a polyoxyethylene adduct of polysiloxane; fluorine-containing surfactants such as a perfluoroalkylcarboxylic acid, a perfluoroalkylsulfonic acid, and an oxyethyleneperfluoroalkyl ether, natural or biosurfactants such as lecithin, spicrispolic acid, rhamnolipid, saponin, and cholate can also be used.

The surfactants described above may be used either alone or in combination. The molecular weight of the surfactant is not limited, but is preferably in the range of 150 to 1,000. No surfactant of 150 or less in molecular weight exists substantially.

A compound having a molecular structure similar to that of the surfactant described above and having a molecular weight of 1,000 to 20,000 can be added to the ink as a water-soluble polymer.

Furthermore, in order to control the ink characteristics, polyethyleneimine, polyamines, polyvinylpyrrolidone, ethylene glycol, cellulose derivatives such as ethyl cellulose and a carboxyethyl cellulose; polysaccharides and derivatives thereof; other water-soluble polymers and polymer emulsions; cyclodextrin, macrocyclic amines, dendrimer, crown ethers, urea and derivatives thereof; acetamide, trimethylolethane, and trimethylolpropane can be used.

Moreover, the ink can also contain an antioxydant, an anti-fungi agent, a conductivity imparting agent, an ultraviolet absorbent, and a chelating agent.

Examples of usable chelating agent include ethylenediamine tetraacetic acid (EDTA), imino diacetic acid (IDA), ethylenediamine-di (o-hydroxyphenylacetic acid) (EDDHA), nitrilo triacetic acid (NTA), dihydroxyethylglycine (DHEG), trans-1,2-cyclohexanediamine tetraacetic acid (CyDTA), diethylenetriamine-N,N,N',N',N'-pentaacetic acid (DTPA), and glycoletherdiamine-N,N,N',N'-tetraacetic acid (GEDTA).

It is useful to add a viscosity adjusting agent to the ink, such as methyl cellulose, ethyl cellulose and derivatives thereof; glycerins, polyglycerins and a polyethylene oxide adduct thereof and a polypropylene oxide adduct thereof; and polysaccharides and derivatives thereof.

Specific examples thereof include glucose, fructose, mannitol, D-sorbitol, dextran, zanthan gum, cardlan, cycloamylose, multitol and derivatives thereof.

A pH adjustment of the ink can be performed if necessary. Examples of pH adjusting agent for adjusting a pH value of the ink include potassium hydroxide, sodium hydroxide, lithium hydroxide, ammonium hydroxide, triethanol amine, diethanol amine, ethanol amine, 2-amino-2-methyl-2-propanol, ammonia, ammonium phosphate, potassium phosphate, sodium phosphate, lithium phosphate, sodium sulfate, an acetate, a lactate, a benzoate, acetic acid, hydrochloric acid, nitric acid, sulfuric acid, phophoric acid, propionic acid, and p-toluene sulfonic acid. Alternatively, any of general pH buffers can be used.

pH and Viscosity of Ink

A pH range of the ink is not limited, but is preferably in the range of 3 to 11 and more preferably in the range of 4.5 to 9.5.

In the case of the ink including a pigment having an anionic free radical on the surface thereof, the pH value of the ink is preferably in the range of 6 to 11, more preferably in the range of 6 to 9.5 and especially preferably in the range of 7.5 to 9.0.

In the case of the ink including a pigment having a cationic free radical on the surface thereof, the pH value of the ink is preferably in the range of 4.5 to 8.0 and more preferably in the range of 4.5 to 7.0.

The viscosity of the ink is preferably in the range of 1 to 8 cP at 20° C. and more preferably in the range of 2 to 5 cP at 20° C.

If the viscosity is higher than 8 cP, discharging of the ink from a nozzle may become unstable. In addition, if the viscosity is less than 1 cP, discharging of the ink from a nozzle may become unstable.

<Ink-jet Recording Apparatus (Printer)>

Next, description of an ink-jet recording apparatus preferably adopted in the ink-jet recording method of the invention will be given below.

An ink-jet recording apparatus adopted in the ink-jet recording method of the invention comprises at least an ink-jet recording printer head, which accommodates one or more kinds of ink and has a nozzle face on which at least one nozzle is provided, and a printer head rotating means (hereinafter, also referred to as a "head rotating means") capable of moving, when printing is being stopped, an axis intersecting with the nozzle face at a right angle such that it is displaced from a direction of the axis when printing is being conducted, ordinarily the direction of gravitational axis, by 3 or more degrees.

The head rotating means is required to move the head when printing is being stopped, such that the above-described axis is displaced from the direction of the axis (nozzle axis) when printing is being conducted, normally the direction of a gravitational axis, by an angle of 3 or more degrees. It is practically preferable that the head rotating means has a function capable of reversibly rotating the head such that the nozzle axis is aligned in the original printing direction when printing is restarted.

An example of a usable head rotating means includes a rotatable driving device such as a motor.

For the printer of the invention, any of other components of the printer is not limited as long as the printer has the head and the head rotating means as described above, but any printer can be used that has any arbitrary combination of components of known printers as required. Specific examples thereof include, but are not limited to, a printer as shown in FIGS. 1A and 1B.

Specific Example of Ink-jet Recording Apparatus

Figure 1B:
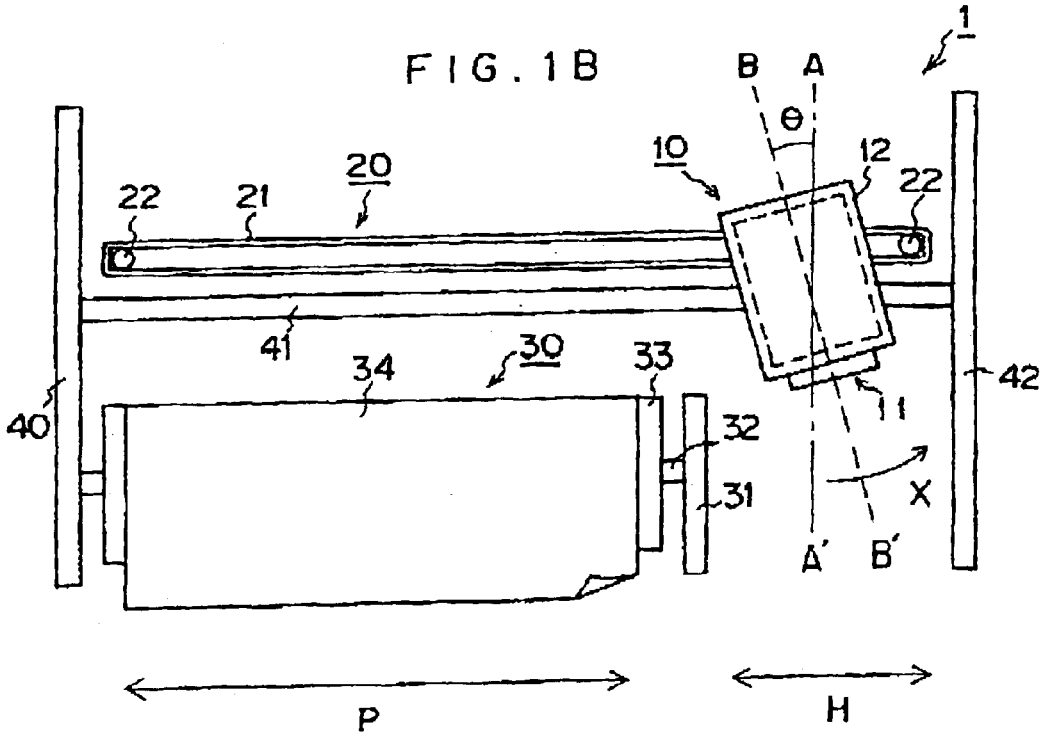
FIG. 1B is a front view showing a state (at the time of standby) where an axis intersecting a nozzle face at a right angle is rotated such that it deviates from a gravitational direction when printing is being stopped.

FIGS. 1A and 1B show one example of the internal structure of an ink-jet recording apparatus of the invention, and FIG. 1A shows a state when printing is being conducted and FIG. 1B shows a state after the nozzle axis is moved such that it is displaced from a gravitational direction and when printing is being stopped. FIGS. 1A and 1B show only a main portion necessary for description of the invention and other components are omitted.

Main Configuration of Ink-jet Recording Apparatus

In FIGS. 1A and 1B, reference numerals 1, 10, 11, 12, 20, 21, 30, 31, 32, 33, 34, and 40, 41 and 42 indicate an ink-jet recording apparatus (printer), an ink-jet recording printer head (head), a nozzle face, an ink accommodating section, a carriage, a carriage belt, rotary shafts, a paper feeding section, a support, a rotary shaft, a paper feeding roll, a recording medium, and frames, respectively.

The printer 1 shown in FIGS. 1A and 1B is installed on a horizontal plane perpendicular to the gravitational axis, and a line A–A' indicates a direction parallel to the gravitational axis. The direction from a mark A toward a mark A' means a direction of the gravitational axis and, in the following description, (a surface facing) the direction of the gravitational axis is expressed as the lower side, or the lower direction (the lower surface), while (a surface facing) a direction opposite to the direction of the gravitational axis is expressed as the upper side, or the upper direction (the upper surface).

The head 10 is mounted on the carriage 20 via a head support not shown, and can be moved in directions pointed by arrows R and L, which directions are perpendicular to the gravitational axis, by the carriage 20. When printing is being conducted as shown in FIG. 1A, the head 10 is moved in the direction of the arrow R or the arrow L within a range shown by a double head arrow P (hereinafter, referred to as a "print position P") according to image information. When printing is over, the head 10 is moved in the direction of the arrow R to rest in a range shown by a double arrow H (hereinafter, referred to as a "home position H") as shown in FIG. 1B.

An ink accommodating section 12, such as an ink cartridge, indicated by a dotted line is provided in the interior of the head 10, and an ink is contained in the ink accommodating section 12. The ink contained in the ink accommodating section 12 is discharged from the nozzle face 11 onto a surface of the recording medium 34 through a nozzle not shown when printing is being conducted.

Figure 2:
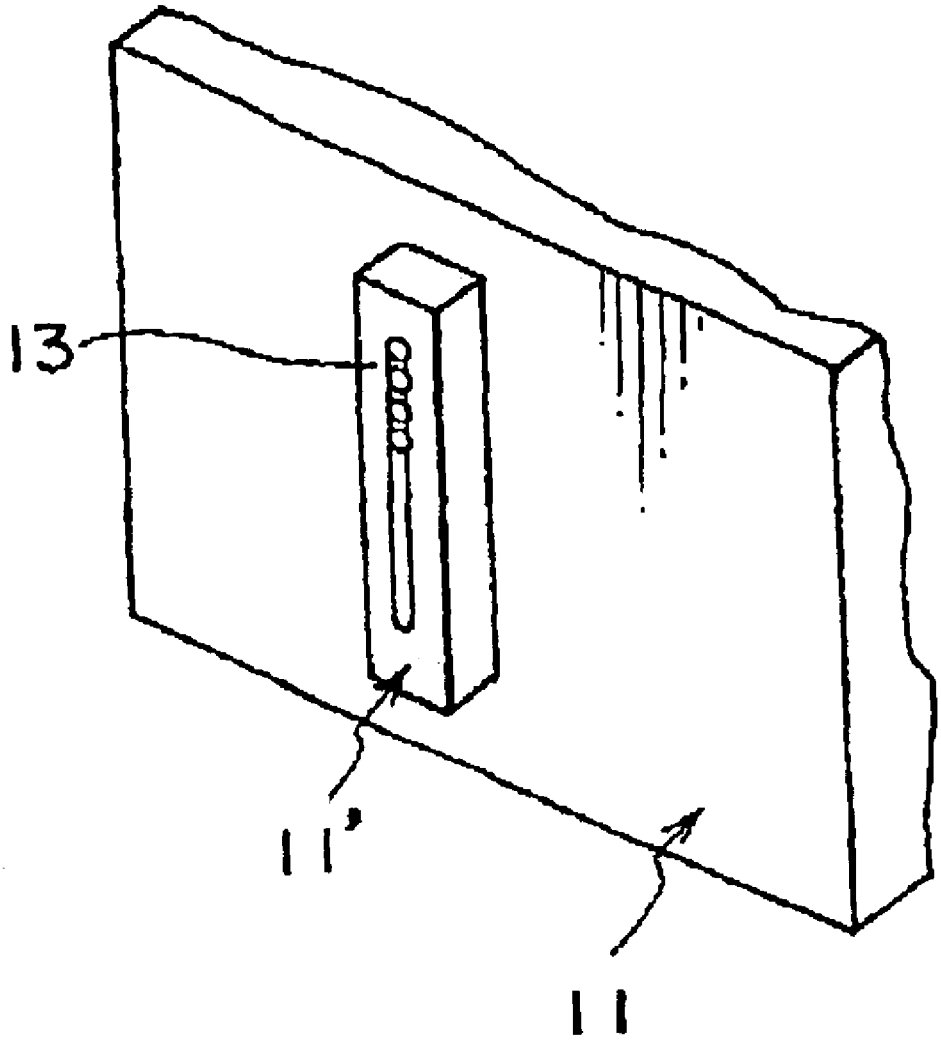
FIG. 2 is a perspective view of the nozzle face 11 shown in FIGS. 1A and 1B.

The nozzle face 11 is provided at the lower surface of the head 10. FIG. 2 is a perspective view of the nozzle face 11 shown in FIGS. 1A and 1B. In FIG. 2, numerical marks 11 and 11' indicate the nozzle faces. The nozzle faces 11 and 11' are planes parallel to each other. Nozzles (ink jetting holes) 13 are formed on the nozzle face 11' and the ink contained in the ink accommodating section 12 is discharged from the nozzles 13.

The nozzle face 11 is fixed, when the head 10 is disposed in the print position P as shown in FIG. 1A, so as to intersect with an axis indicated by a dotted line A–A' at a right angle.

On the other hand, when the head 10 is disposed in the home position 11 as shown in FIG. 1B, the head 10 is rotatable in a direction X or in a direction opposite to the direction X with a head rotating means not shown so that the nozzle face 11 can intersect with an axis indicated by the dotted line A–A' or an axis indicated by a dotted line B–B'.

The carriage 20 has two rotary shafts 22 provided at both ends of the carriage 20, and a carriage belt 21 wound between the rotary shafts 22. The carriage belt 21 can be rotated by a driving source not shown in directions indicated by the arrow R or the arrow L which directions intersect with the gravitational axis at a right angle.

The paper feeding section 30 has a support 31, the rotary shaft 32 provided between the support 31 and a frame 40 so as to be parallel to the carriage 20, and a paper feeding roll 33 attached on an outer peripheral surface of the rotary shaft 32. The paper feeding roll 33 can be rotated by the driving source not shown connected to the rotary shaft 32 in a direction indicated by of an arrow F (a direction from the back side of the sheet on which the figure is depicted to the front side thereof). The head 10 is, as shown in FIG. 1A, located over the upper side of the paper feeding roll 33 so that the nozzle face 11 is close to the surface of the paper roll 33 when printing is being conducted.

The frame 41 is provided in the interior of the printer 1 so as to be parallel to the carriage belt 20 and fixed by the frames 40 and 42, and used to support and fix the carriage belt 20 and other components not shown in the interior of the printer 1. The frames 40 and 42 also support and fix various components provided in the printer 1.

Operations when Printing is being Conducted and when Printing is being Stopped

Next, description of operations of the printer 1 shown in FIG. 1A when printing is being conducted and operations of the printer 1 shown in FIG. 1B when printing is being stopped will be given below.

When printing is being conducted, the recording medium 34 is at first fed by a paper feeding means not shown onto a surface of the paper feeding roll 33 so as to pass between the paper feeding roll 33 and the nozzle face 11 and an ink is discharged from the nozzle face 11 according to image information when the recording medium 34 is passing directly below the nozzle face 11 and thereby an image is printed on the surface of the recording medium 34. Thereafter, the recording medium 34 on which the image has been printed is discharged to the outside of the printer 1 (for example, onto a paper discharging tray or the like).

At this time, as shown in FIG. 1A, the head 10 is moved in the direction indicated by the arrow R or in the direction indicated by the arrow L in the P position according to image information, with the nozzle face 11 facing the ground surface side.

On the other hand, when printing is over, the head 10 is moved in the direction indicated by the arrow R to rest at the home position H. Thereafter, when a prescribed time elapses from the termination of printing, the printer 1 or an external equipment such as a personal computer connected to the printer 1 to control the printer 1 recognizes that a print-ready state has been terminated, and the head 10 is rotated by the head rotating means not shown in the direction of the arrow X to thereby direct the nozzle face 11 from the direction perpendicular to the line A–A' to the direction perpendicular to the dotted line B–B'.

Note that an angle θ (hereinafter, referred to as a "rotational angle θ") formed between the line A–A' and the dotted line B–B' shown in FIG. 1B is set to at least 3° in order to prevent nozzle clogging after leaving the printer unused.

When printing is restarted, the head 10 resting such that the nozzle face 11 intersects with the dotted line B–B' at a right angle is rotated by the head rotating means not shown in a direction opposite to the direction of the arrow X so that the nozzle face 11 intersects with the line A–A' at a right angle. Thereafter, the head 10 is moved in the direction of the arrow L to restart a printing operation as described above at the print position P.

Other Configuration of Ink-jet Recording Apparatus

In the printer 1 shown in FIGS. 1A and 1B, a rotating direction of the axis intersecting the nozzle face 11 at a right angle is the direction indicated by the arrow X but is not limited thereto, and may be, for example, a direction intersecting the paper sheet on which the figure is depicted.

A wiper blade for removing unnecessary matter such as ink or dust attached on the nozzle face 11, and a cap for covering the nozzle face 11 in order to prevent the nozzle face from drying may also be provided at the home position H and in a space in the vicinity thereof.

Further, one head 10 is provided in the printer 1 shown in FIGS. 1A and 1B, but the head number is not limited to one, and may be at least two.

EXAMPLES

Examples of the invention will be explained below. The invention is, however, not limited to the following examples.

<Ink-jet Recording Apparatus>

A printer having a configuration similar to that of the printer 1 shown in FIGS. 1A and 1B was used in the examples.

In order to discharge ink, a thermal ink-jet method was adopted and the printer 1 included the head 10 having a heater (not shown) at the bottom face thereof. The heater was constructed by stacking a protective layer made of tantalum on a heater layer made of a polysilicon and wired so that a predetermined signals instructing the heater to generate heat were applied to the heater by a signal applying means not shown at timings according to image signals.

Furthermore, 300 nozzles 13 which were a circle having a diameter of 20 $\mu$m and which were formed by laser processing were provided on the nozzle face 11 so as to obtain a resolution of 800 dpi.

<Evaluation on Nozzle Clogging after Leaving the Printer Unused and Optical Density>

Evaluation on the nozzle clogging after leaving the printer unused was conducted according to a procedure described below after the printer 1 was placed on a flat table.

As shown in FIG. 1A, the head 10 was at first moved to the print position P, an ink was discharged from the nozzle face 11 and a nozzle check pattern was printed, and it was confirmed that ink was discharged from all of the nozzles by observing the resultant printed image.

Then, the printing operation was terminated and the head 10 was left as it was in the environment at 23° C. and 55% RH for 2 weeks. At this time, the head 10 was moved to the home position H immediately after the printing was over. When several minutes elapsed from movement of the head to the home position H, the axis intersecting with the nozzle face 11 at a right angle was displaced from the direction of the gravitational axis and then the head completely rested. Here, a rotational angle θ of the axis intersecting with the nozzle face 11 at a right angle was set to a desired angle within the range of 0° to 90°.

When 2 weeks elapsed after the termination of the printing operation, the printer 1 was again operated in order to print a predetermined image. Before printing, a direction of the axis intersecting with the nozzle face 11 at a right angle was rotated in a direction opposite to the direction X and returned to the original position and thereafter, the head 10 was moved to the print position P to print a pattern obtained by causing all of the no nozzles to discharge an ink.

Evaluation on nozzle clogging after leaving the printer unused, when the printing was restarted, was performed by counting, form printed images, the number of signals instructing the heater to generate heat output (i.e. how many pulses were output) until nozzle clogging in all the nozzles was removed in the case where a pattern in a quarter tone was printed.

Furthermore, after it was confirmed that nozzle clogging after leaving the printer unused was perfectly removed in all the nozzles, a 100% solid pattern was printed and an optical density of the printed image was measured with an X-Rite 404 (made by X-Rite, Incorporated).

Multiace paper, P paper and WR paper (made by Fuji Xerox office Supply Co.) and 4024 paper (made by Xerox Co.) were used as a recording medium 34 in measurement of optical densities, and an average and a standard deviation of the optical densities were measured.

<Ink>

The following inks 1 to 4 were used in evaluations on nozzle clogging after leaving the printer unused and optical densities described above.

Ink 1

A mixed solution was obtained by adding an water-soluble organic solvent, surfactants, a deionized water and the like to a liquid dispersion of carbon black self-dispersible in water (Microjet Black CW-2 made by Orient Chemical Industries, Ltd.) so that a total weight was 100 parts by weight and a pigment concentration was 5 parts by weight.

Then, the mixed solution was sufficiently stirred, and filtered with a 5 $\mu$m pore filter to obtain Ink 1 of the following composition.

Composition of Ink 1

| | |
|---|---|
| Solid content of liquid dispersion of carbon black (Microjet Black CW-2 made by Orient Chemical Industries, Ltd.) | 5 parts by weight |
| glycerin | 12 parts by weight |
| diethylene glycol | 3 parts by weight |
| urea | 4 parts by weight |
| surfactant (Surfinol 465 made by Nisshin Chemicals Co., Ltd.) | 0.2 part by weight |
| surfactant (Nonion E-230 made by NOF Co., Ltd.) | 0.5 part by weight |
| deionized water | 75.3 parts by weight |

The number of particles of the water-insoluble substance contained in Ink 1 having a particle diameter of 0.5 $\mu$m to 5 $\mu$m was $200\times10^4$ per $\mu$l of Ink 1.

Ink 2

A centrifugation treatment was performed on a liquid dispersion of carbon black self-dispersible in water (Microjet Black CW-2 made by Orient Chemical Industries, Ltd.) at 7,000 rpm for 20 minutes to collect, as a liquid dispersion A, 95% by weight of a supernatant relative to 100% by weight of the liquid dispersion.

Thereafter, a mixed solution was obtained by adding a water-soluble organic solvent, surfactants, a deionized water and the like to the liquid dispersion A so that a total weight was 100 parts by weight and a pigment concentration was 5 parts by weight.

Then, the mixed solution was sufficiently stirred and filtered with a 5 $\mu$m pore filter to obtain Ink 2 of the following composition.

Composition of Ink 2

| | |
|---|---|
| Solid content of liquid dispersion A obtained by applying a centrifugation treatment to liquid dispersion of carbon black (Microjet Black CW-2 made by Orient Chemical Industries, Ltd.) | 5 parts by weight |
| diethylene glycol | 20 parts by weight |
| surfactant (Surfinol 465 made by Nisshin Chemicals Co., Ltd.) | 0.2 part by weight |
| surfactant (Nonion E-230 made by NOF Co., Ltd.) | 0.5 part by weight |
| deionized water | 74.3 parts by weight |

The number of particles of the water-insoluble substance contained in Ink 2 in having a particles diameter of 0.5 $\mu$m to 5 $\mu$m was $60\times10^4$ per 1 $\mu$l of Ink 2.

Ink 3

A centrifugation treatment was performed on a liquid dispersion of carbon black self-dispersible in water (Microjet Black CW-2 made by Orient Chemical Industries, Ltd.) at 7,000 rpm for 20 minutes to collect, as a liquid dispersion A, 95% by weight of a supernatant portion relative to 100% by weight of the liquid dispersion. Furthermore, the second centrifugation treatment was performed on the dispersion A to collect, as a liquid dispersion B, 95% by weight of a supernatant relative to 100% by weight of the liquid dispersion A.

Thereafter, a mixed solution was obtained by adding a water-soluble organic solvent, surfactants, a deionized water and the like to the dispersion B so that a total weight was 100 parts by weight and a pigment concentration was 5 parts by weight.

Then, the mixed solution was sufficiently stirred and filtered with a 5 μm pore filter to obtain Ink 3 of the following composition.

Composition of Ink 3

| | |
|---|---|
| Solid content of dispersion B obtained by applying a centrifugation treatment to liquid dispersion of carbon black (Microjet Black CW-2, made by Orient Chemical Industries, Ltd.) | 5 parts by weight |
| diethylene glycol | 20 parts by weight |
| surfactant (Surfinol 465 made by Nisshin Chemicals Co., Ltd.) | 0.2 part by weight |
| surfactant (Nonion E-230 made by NOF Co., Ltd.) | 0.5 part by weight |
| deionized water | 74.3 parts by weight |

The number of particles of the water-insoluble substance contained in Ink 3 having a particle diameter of 0.5 μm to 5 μm particle diameter was $5\times10^4$ per 1 μl of Ink 3.

Ink 4

A centrifugation treatment was performed on a liquid dispersion of carbon black self-dispersible in water (Cab-o-jet300 made by Cabot Corporation) at 7,000 rpm for 20 minutes to collect, as a dispersion C, 95% by weight of a supernatant relative to 100% by weight of the liquid dispersion C.

Thereafter, a mixed solution was obtained by adding a water-soluble organic solvent, surfactants, a deionized water and the like to the dispersion C so that a total weight was 100 parts by weight and a pigment concentration was 5 parts by weight.

Then, the mixed solution was sufficiently stirred and filtered through a 5 μm pore filter to obtain Ink 4 of the following composition.

Composition of Ink 4

| | |
|---|---|
| Solid content of dispersion C obtained by applying a centrifugation treatment to liquid dispersion of carbon black (Cab-o-jet300 made by Cabot Corporation) | 5 parts by weight |
| diethylene glycol | 20 parts by weight |
| surfactant (Surfinol 465 made by Nisshin Chemicals Co., Ltd.) | 0.2 part by weight |
| surfactant (Nonion E-230 made by NOF Co., Ltd.) | 0.5 part by weight |
| deionized water | 74.3 parts by weight |

The number of particles of the water-insoluble substance contained in Ink 4 having a particle diameter of 0.5 μm to 5 μm was $0.5\times10^4$ per 1 μl of Ink 4.

Evaluation Results

For evaluation, Inks 1 to 4 described above were used and the head was rotated with rotational angles θ of the axis intersecting with the nozzle face 11 at a right angle set to 0°, 5°, 45° and 90°, and the printer was left unused for 2 weeks. Evaluation results of nozzle clogging after leaving the printer unused are shown in Table 1, and evaluation results of optical densities of printed images are shown in Table 2 together with the numbers of particles made of the water-insoluble substance contained in the inks having a particle diameter of 0.5 μm to 5 μm.

TABLE 1

| Rotational angles θ(°) | Evaluations of nozzle clogging after leaving the printer unused | | | |
|---|---|---|---|---|
| | Ink 1 | Ink 2 | Ink 3 | Ink 4 |
| 0 | X | X | Δ | Δ |
| 5 | ○ | ○ | ○ | ○ |
| 45 | ○ | ○ | ○ | ○ |
| 90 | ○ | ○ | ○ | ○ |

TABLE 2

| | Ink 1 | Ink 2 | Ink 3 | Ink 4 |
|---|---|---|---|---|
| Optical densities | | | | |
| Average values | 1.50 | 1.45 | 1.42 | 1.30 |
| Standard deviations | 0.07 | 0.10 | 0.15 | 0.24 |
| Numbers of particles having a particle diameter of from 0.5 μm to 5 μm(particles/μl) | $200\times10^4$ | $60\times10^4$ | $5\times10^4$ | $0.5\times10^4$ |

Evaluations of nozzle clogging after leaving the printer unused shown in Table 1 was implemented with the following criteria:

○: Nozzle clogging after leaving the printer unused was removed in all of nozzles with application of less than 10,000 pulses.

Δ: Nozzle clogging after leaving the printer unused was removed in all of nozzles with application of 10,000 pulses to 50,000 pulses.

X: Nozzle clogging after leaving the printer unused was not removed in at least part of nozzles even if more than 50000 pulses were applied to the head.

As is clear from Table 1, at a rotational angle of 0°, any of the inks caused nozzle clogging after leaving the printer unused and especially Inks 1 and 2 more conspicuously caused nozzle clogging after leaving the printer unused than Inks 3 and 4. At a rotational angle of 5 or more degrees, none of the inks caused nozzle clogging after leaving the printer unused.

Furthermore, as is clear from Table 2, with the increase in the number of particles made of the water-insoluble substance included in the ink having a particle diameter of 0.5 μm to 5 μm, printed images with higher optical density but a smaller variation in optical density were obtained.

From the results, it was found that, especially, the invention can provide printed images with high optical density and enables effective prevention of nozzle clogging after leaving the printer unused, even if an ink which tends to cause the clogging is used.

What is claimed is:

1. An ink-jet recording method adopting an ink-jet recording apparatus comprising a printer head, which accommodates one or more kinds of ink and has a nozzle face on which one or more nozzles are provided, wherein the printer head is disposed at a home position, adjoining by a direction of travel a print position where printing is conducted, when printing is being stopped, and when a prescribed period of time has not elapsed since printing is terminated, an axis intersecting with the nozzle face at a right angle is parallel to the axis when printing is being conducted, and when the prescribed period of time has elapsed since printing is terminated, the print head is tilted so that the axis is displaced by 3 or more degrees from a direction of the axis when printing is being conducted, the axis being oriented perpendicular to the direction of travel.

2. The ink-jet recording method of claim 1, wherein the direction of the axis when printing is being conducted is a direction of a gravitational axis.

3. The ink-jet recording method of claim 2, wherein the one or more kinds of ink contain at least one water-insoluble substance.

4. The ink-jet recording method of claim 3, wherein the water-insoluble substance are particles having a volume mean diameter of 50 nm to 250 nm.

5. The ink-jet recording method of claim 4 wherein the number of particles of the water-insoluble substance having a particle diameter of 0.5 $\mu$m to 5 $\mu$m is in the range of $0.2\times10^4$ particles to $1000\times10^4$ particles per $\mu$l of an ink.

6. The ink-jet recording method of claim 3, wherein the number of particles of the water-insoluble substance having a particle diameter of 0.5 $\mu$m to 5 $\mu$m is in the range of $0.2\times10^4$ particles to $1000\times10^4$ particles per $\mu$l of an ink.

7. The ink-jet recording method of claim 1, wherein the printer head is tilted so that the axis intersecting with the nozzle face at a right angle is tilted such that the nozzle moves away from a recording medium when the prescribed period of time has elapsed since printing is terminated.

8. The ink-jet recording method of claim 1, wherein the printer head is tilted when the prescribed period of time has elapsed since printing is terminated, so that the axis intersecting with the nozzle face at a right angle is displaced by 5 or more degrees from the direction of the axis when printing is being conducted.

9. The ink-jet recording method of claim 1, wherein the printer head discharges ink droplets with thermal energy.

10. The ink-jet recording method of claim 1, wherein the one or more kinds of ink contain at least one water-insoluble substance.

11. The ink-jet recording method of claim 10, wherein the water-insoluble substance are particles having a volume mean diameter of 50 nm to 250 nm.

12. The ink-jet recording method of claim 11, wherein the number of particles of the water-insoluble substance having a particle diameter of 0.5 $\mu$m to 5 $\mu$m is in the range of $0.2\times10^4$ particles to $1000\times10^4$ particles per $\mu$l of an ink.

13. The ink-jet recording method of claim 11, wherein the water-insoluble substance includes a pigment.

14. The ink-jet recording method of claim 10, wherein the number of particles of the water-insoluble substance having a particle diameter of 0.5 $\mu$m to 5 $\mu$m is in the range of $0.2\times10^4$ particles to $1000\times10^4$ particles per 1 $\mu$l of an ink.

15. The ink-jet recording method of claim 14, wherein the water-insoluble substance includes a pigment.

16. The ink-jet recording method of claim 10, wherein the water-insoluble substance includes a pigment.

17. An ink-jet recording apparatus, comprising:

a printer head having a unit accommodating one or more kinds of ink and a nozzle face on which one or more nozzles are provided; and a printer head rotating means, wherein the printer head is disposed at a home position, adjoining by a direction of travel a print position where printing is conducted, when printing is being stopped, and when a prescribed period of time has not elapsed since printing is terminated, an axis intersecting with the nozzle face at a right angle is parallel to the axis when printing is being conducted, and when the prescribed period of time has elapsed since the printing is terminated, the printer head is tilted so that the axis is displaced by 3 or more degrees from a direction of the axis when printing is being conducted, the axis being oriented perpendicular to the direction of travel.

18. The ink-jet recording apparatus of claim 17, wherein the direction of the axis when printing is being conducted is a direction of a gravitational axis.

19. The ink-jet recording apparatus of claim 17, wherein the printer head is tilted so that the axis intersecting with the nozzle face at a right angle is tilted such that the nozzle face moves away from a recording medium when the prescribed period of time has elapsed since printing is terminated.

20. An ink-jet recording method adopting an ink-jet recording apparatus comprising a printer head, which accommodates one or more kinds of ink and has a nozzle face on which one or more nozzles are provided, wherein the printer head is disposed at a home position, adjoining by a direction of travel a print position where printing is conducted, when printing is being stopped, and when a period between ten seconds and ten minutes has not elapsed since printing is terminated, an axis intersecting with the nozzle face at a right angle is parallel to the axis when printing is being conducted, and when the prescribed period of time has elapsed since printing is terminated, the print head is tilted so that the axis is displaced by 3 or more degrees from a direction of the axis when printing is being conducted, the axis being oriented perpendicular to the direction of travel.

21. An ink-jet recording apparatus, comprising:

a printer head having a unit accommodating one or more kinds of ink and a nozzle face on which one or more nozzles are provided; and a printer head rotating means, wherein the printer head is disposed at a home position, adjoining by a direction of travel a print position where printing is conducted, when printing is being stopped, and when a period between ten seconds and ten minutes has not elapsed since printing is terminated, an axis intersecting with the nozzle face at a right angle is parallel to the axis when printing is being conducted, and when the prescribed period of time has elapsed since the printing is terminated, the printer head is tilted so that the axis is displaced by 3 or more degrees from a direction of the axis when printing is being conducted, the axis being oriented perpendicular to the direction of travel.

* * * * *